US009480880B2

(12) United States Patent
Morgan et al.

(10) Patent No.: US 9,480,880 B2
(45) Date of Patent: Nov. 1, 2016

(54) GOLF BALL WITH TRANSLUCENT COVER

(71) Applicant: Acushnet Company, Fairhaven, MA (US)

(72) Inventors: William E. Morgan, Barrington, RI (US); Kevin M. Harris, New Bedford, MA (US); Edmund A. Hebert, Mattapoisett, MA (US); Matthew F. Hogge, Plymouth, MA (US); Shawn Ricci, New Bedford, MA (US); Peter L. Serdahl, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 139 days.

(21) Appl. No.: 14/108,394

(22) Filed: Dec. 17, 2013

(65) Prior Publication Data

US 2014/0106905 A1 Apr. 17, 2014

Related U.S. Application Data

(63) Continuation of application No. 12/359,619, filed on Jan. 26, 2009, now Pat. No. 8,617,004, which is a continuation-in-part of application No. 11/707,493, filed on Feb. 16, 2007, now Pat. No. 7,722,483, which is a continuation of application No. 10/384,417, filed on Mar. 7, 2003, now abandoned.

(51) Int. Cl.
*A63B 37/06* (2006.01)
*A63B 37/00* (2006.01)
(Continued)

(52) U.S. Cl.
CPC ..... *A63B 37/0023* (2013.01); *A63B 37/0005* (2013.01); *A63B 37/007* (2013.01); *A63B 37/0013* (2013.01); *A63B 37/0022* (2013.01); *A63B 37/0024* (2013.01);
(Continued)

(58) Field of Classification Search
CPC ..... A63B 37/12
USPC ..... 473/378
See application file for complete search history.

(56) References Cited

U.S. PATENT DOCUMENTS 2,283,845 A 1/1940 Brown
2,809,954 A 10/1957 Kazenas
(Continued)

FOREIGN PATENT DOCUMENTS

JP 2001-087423 4/2001

OTHER PUBLICATIONS

Larry Dennis and Udo Machat, The Golf Ball Book, Sep. 2000, Sports Images, p. 47.*
(Continued)

*Primary Examiner* — Raeann Gorden
(74) *Attorney, Agent, or Firm* — Margaret C. Barker

(57) ABSTRACT

The present invention is directed a golf ball comprising a core and a cover and an optional intermediate layer disposed between the core and cover, wherein at least one of the core and the intermediate layer comprises any Pantone Matching System color including blue, green, yellow, pink, or orange having an L* value of about 80 or less; and wherein the cover comprises a translucent thermoset polyurethane material and an amount of pigment or dye such that the cover has any Pantone Matching System color including blue, green, yellow, pink, or orange that has an L* value of about 80 or less. The thermoset polyurethane material may be formed from an aliphatic isocyanate-based composition.

19 Claims, 11 Drawing Sheets

(51) Int. Cl.
*A63B 37/12* (2006.01)
*A63B 43/06* (2006.01)
*A63B 43/00* (2006.01)

(52) U.S. Cl.
CPC ..... *A63B 37/0027* (2013.01); *A63B 37/0075* (2013.01); *A63B 37/12* (2013.01); *A63B 43/06* (2013.01); *A63B 37/0003* (2013.01); *A63B 37/0004* (2013.01); *A63B 43/008* (2013.01)

(56) References Cited

U.S. PATENT DOCUMENTS 2,851,424 A 9/1958 Switzer et al.
2,938,873 A 5/1960 Kazenas
3,253,146 A 5/1966 de Vries
3,412,036 A 11/1968 McIntosh
D228,394 S 9/1973 Martin et al.
3,989,568 A 11/1976 Isaac
4,123,061 A 10/1978 Dusbiber
4,128,600 A 12/1978 Skinner et al.
4,317,933 A 3/1982 Parker
4,342,793 A 8/1982 Skinner et al.
4,560,168 A 12/1985 Aoyama
4,679,795 A 7/1987 Melvin et al.
4,798,386 A * 1/1989 Berard ..... A63B 37/0003 264/239
4,804,189 A 2/1989 Gobush
4,921,759 A 5/1990 Orain et al.
4,925,193 A 5/1990 Melvin
4,950,696 A 8/1990 Palazotto et al.
4,960,281 A 10/1990 Aoyama
4,985,340 A 1/1991 Palazzotto et al.
4,991,852 A 2/1991 Pattison
4,998,734 A 3/1991 Meyer
5,000,458 A 3/1991 Proudfit
5,018,742 A 5/1991 Isaac et al.
5,143,377 A 9/1992 Oka et al.
5,147,900 A 9/1992 Palazzotto et al.
5,156,405 A 10/1992 Kitaoh et al.
5,249,804 A 10/1993 Sanchez
5,256,170 A 10/1993 Harmer et al.
5,326,621 A 7/1994 Palazzotto et al.
5,334,673 A 8/1994 Wu
5,360,462 A 11/1994 Harmer et al.
5,376,428 A 12/1994 Palazzotto et al.
5,427,378 A 6/1995 Murphy
5,442,680 A 8/1995 Schellinger et al.
5,484,870 A 1/1996 Wu
5,494,291 A 2/1996 Kennedy
5,508,350 A 4/1996 Cadorniga et al.
5,562,552 A 10/1996 Thurman
5,575,477 A 11/1996 Hwang
5,605,761 A 2/1997 Burns et al.
5,672,643 A 9/1997 Burns et al.
5,674,622 A 10/1997 Burns et al.
5,688,191 A 11/1997 Cavallaro et al.
5,692,974 A 12/1997 Wu et al.
5,713,801 A 2/1998 Aoyama
5,783,293 A 7/1998 Lammi
5,800,286 A 9/1998 Kakiuchi et al.
5,803,831 A 9/1998 Sullivan et al.
5,820,488 A 10/1998 Sullivan et al.
5,823,890 A 10/1998 Maruko et al.
5,823,891 A 10/1998 Winskowicz
5,840,788 A 11/1998 Lutz et al.
5,885,172 A 3/1999 Hebert et al.
5,900,439 A 5/1999 Prissok et al.
5,902,191 A 5/1999 Masutani et al.
5,919,100 A 7/1999 Boehm et al.
5,929,189 A 7/1999 Ichikawa et al.
5,938,544 A 8/1999 Winskowicz
5,957,786 A 9/1999 Aoyama
5,957,787 A 9/1999 Hwang
5,965,669 A 10/1999 Cavallaro et al.
5,981,654 A 11/1999 Rajagopalan
5,981,658 A 11/1999 Rajagopalan
5,989,135 A 11/1999 Welch
5,993,968 A 11/1999 Umezawa et al.
6,022,279 A 2/2000 Yamagishi et al.
6,056,842 A 5/2000 Dalton et al.
6,083,119 A 7/2000 Sullivan et al.
6,120,394 A 9/2000 Kametani
6,149,535 A 11/2000 Bissonnette et al.
6,152,834 A 11/2000 Sullivan
6,200,232 B1 3/2001 Kasashima et al.
6,207,784 B1 3/2001 Rajagopalan
6,251,991 B1 6/2001 Takesue et al.
6,277,037 B1 8/2001 Winskowicz et al.
6,358,160 B1 3/2002 Winskowicz
6,369,125 B1 4/2002 Nesbitt
6,450,902 B1 9/2002 Hwang
6,548,618 B2 4/2003 Sullivan et al.
6,558,227 B1 5/2003 Kodaira et al.
6,736,737 B2 * 5/2004 Higuchi ..... A63B 37/0003 473/376
6,790,149 B2 9/2004 Kennedy et al.
6,824,476 B2 11/2004 Sullivan et al.
6,872,154 B2 3/2005 Shannon et al.
6,949,595 B2 9/2005 Morgan et al.
7,090,798 B2 8/2006 Hebert et al.
7,291,076 B2 * 11/2007 Watanabe ..... A63B 37/0023 473/378
2002/0086743 A1 7/2002 Bulpett
2004/0176184 A1 9/2004 Morgan et al.
2004/0176185 A1 9/2004 Morgan et al.
2004/0176188 A1 9/2004 Morgan et al.
2005/0148409 A1 7/2005 Morgan et al.
2007/0149323 A1 6/2007 Morgan et al.
2011/0224020 A1 9/2011 Tachibana et al.

OTHER PUBLICATIONS

Mark S. Murphy; "Just Different Enough" Golf World Business; Apr. 8, 2005; p. 2.
Wilson Hope golf ball, http://www.pargolf.com/products/Wilson-Hope.htm, Jan. 27, 2005.
Color photographs of Volvik "Crystal" golf ball and packaging, 2005.
Volvik Crystal golf ball, http://www.volvik.co.kr/english/product/crystal.asp, Jan. 21, 2005.
Volvik Golf Ball Brochure, 2005, pp. 1, 16-17 and 24.
Color photographs of Volvik "Crystal" golf ball, 2004.
Color photographs of Wilson "iWound", display model only with clear cover, 2001.
"Urea", Kirk-Othmer Encyclopedia of Chemical Technology. John Wiley & Sons, Inc. copyright 1998.
Color Photographs of Wilson "Quantum" golf ball, late 1990s.
Color Photographs of Pro Keds "Crystal π" golf ball, 1980's.

* cited by examiner

GOLF BALL WITH TRANSLUCENT COVER

CROSS-REFERENCE TO RELATED APPLICATIONS

This application is a continuation of co-pending U.S. patent application Ser. No. 12/359,619, filed on Jan. 26, 2009, now U.S. Pat. No. 8,617,004, which is a continuation-in-part of U.S. patent application Ser. No. 11/707,493, filed on Feb. 16, 2007, now U.S. Pat. No. 7,722,483, which is a continuation of U.S. patent application Ser. No. 10/384,417, filed Mar. 7, 2003, abandoned, each of which is incorporated by reference herein in its entirety.

FIELD OF THE INVENTION

The invention relates generally to golf balls and to golf ball covers wherein the outer layer is translucent or transparent.

BACKGROUND OF THE INVENTION

Golf balls, whether of solid or wound construction, generally include a core and a cover. It is known in the art to modify the properties of a conventional solid ball by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or, in many cases, be formed of a tensioned elastomeric winding, which are referred to as wound balls. The difference in play characteristics resulting from these different types of constructions can be quite significant. The playing characteristics of multi-layer balls, such as spin and compression, can be tailored by varying the properties of one or more of these intermediate and/or cover layers.

Manufacturers generally provide the golf ball with a durable cover material, such as an ionomer resin, or a softer cover material, such as polyurethane or polyurea. Chemically, ionomer resins are a copolymer of an olefin and an α,β-ethylenically-unsaturated carboxylic acid having 10-90 percent of the carboxylic acid groups neutralized by a metal ion and are distinguished by the type of metal ion, the amount of acid, and the degree of neutralization. Commercially available ionomer resins include copolymers of ethylene and methacrylic or acrylic acid neutralized with metal salts. Examples include SURLYN® from E.I. DuPont de Nemours and Co. of Wilmington, Del. and IOTEK® from Exxon Corporation of Houston, Tex.

Surrounding the core with an ionomeric cover material provides a very durable golf ball. This core/cover combination permits golfers to impart a high initial velocity to the ball that results in improved distance.

Polyurethanes are used in a wide variety of applications including adhesives, sealants, coatings, fibers, injection molding components, thermoplastic parts, elastomers, and both rigid and flexible foams. Polyurethane is the product of a reaction between a polyurethane prepolymer and a curing agent. The polyurethane prepolymer is generally formed by a reaction between a polyol and a diisocyanate. The curing agents are typically diamines or glycols. A catalyst is often employed to promote the reaction between the curing agent and the polyurethane prepolymer.

Since about 1960, various companies have investigated the usefulness of polyurethane as a golf ball cover material. U.S. Pat. No. 4,123,061 teaches a golf ball made from a polyurethane prepolymer of polyether and a curing agent, such as a trifunctional polyol, a tetrafunctional polyol, or a fast-reacting diamine. U.S. Pat. No. 5,334,673 discloses the use of two categories of polyurethane available on the market, i.e., thermoset and thermoplastic polyurethanes, for forming golf ball covers and, in particular, thermoset polyurethane covered golf balls made from a composition of polyurethane prepolymer and a slow-reacting amine curing agent, and/or a difunctional glycol.

Polyurea covers are formed from a polyurea prepolymer, which typically is formed from at least one diisocyanate and at least one polyether amine, and a curing agent.

Additionally, U.S. Pat. No. 3,989,568 discloses a three-component system employing either one or two polyurethane prepolymers and one or two polyol or fast-reacting diamine curing agents. The reactants chosen for the system must have different rates of reactions within two or more competing reactions.

The color instability caused by both thermo-oxidative degradation and photodegradation typically results in a "yellowing" or "browning" of the polyurethane layer, an undesirable characteristic for urethane compositions are to be used in the covers of golf balls, which are generally white.

U.S. Pat. No. 5,692,974 to Wu et al. discloses golf balls which have covers and cores and which incorporate urethane ionomers. The polyurethane golf ball cover has improved resiliency and initial velocity through the addition of an alkylating agent such as t-butyl chloride to induce ionic interactions in the polyurethane and thereby produce cationic type ionomers. UV stabilizers, antioxidants, and light stabilizers may be added to the cover composition.

U.S. Pat. No. 5,484,870 to Wu discloses a golf ball cover comprised of a polyurea. Polyureas are formed from reacting a diisocyanate with an amine.

U.S. Pat. No. 5,823,890 to Maruko et al., discloses a golf ball formed of a cover of an inner and outer cover layer compression molded over a core. The inner and outer cover layers should have a color difference ΔE in Lab color space of up to 3.

U.S. Pat. No. 5,840,788 to Lutz et al. discloses a UV light resistant, visibly transparent, urethane golf ball topcoat composition for use with UV curable inks. The topcoat includes an optical brightener that absorbs at least some UV light at wavelengths greater than about 350 nm, and emits visible light, and a stabilizer package. The light stabilizer package includes at least one UV light absorber and, optionally, at least one light stabilizer, such as a hindered amine light stabilizer ("HALS").

U.S. Pat. No. 5,494,291 to Kennedy discloses a golf ball having a fluorescent cover and a UV light blocking, visibly transparent topcoat. The cover contains a fluorescent material that absorbs at least some UV light at wavelengths greater than 320 nm and emits visible light.

Colored golf balls have been produced for many years. In the 1960s Spalding produced a yellow range ball with a blended cover that included polyurethane.

U.S. Pat. No. 4,798,386, to Berard, makes reference to white cores and clear covers and even locating decoration on the core to be visible through the clear cover. The Berard concept requires a core which has a satisfactory hue to achieve the desired finished ball coloration. A polybutadiene rubber core of such a color has never been produced and as such, clear cover 2-pc ball have had limited market success.

U.S. Pat. No. 4,998,734 to Meyer, describes a golf ball with a core, a clear cover and "layer interdisposed therebetween." However, the intermediate layer described is a thin layer of paper or plastic material whose purpose is only to bear textural, alphanumeric or graphical indicia. Meyer teaches that the layer should be sufficiently thin to permit substantial transference of impact forces from the cover to the core without substantially reducing the force.

The Pro Keds "Crystal π" golf ball appeared in the Japanese market. It had a white core bearing the ball markings and a clear Surlyn cover. This ball had a very thick clear cover (>0.065") and the surface dimple coverage was very low.

In the early 1990s, Acushnet made clear Surlyn cover, two-piece Pinnacle Practice balls. The covers were 0.050" thick.

A prototype Wilson Surlyn covered two-piece ball, "Quantum", of a design similar to the Pro Keds ball was found in the US in the late 1990s. The cover was greater than 0.065 inches thick.

U.S. Pat. No. 5,442,680, Proudfit is directed to a golf ball with a clear ionomer cover. The patent requires a blend of ionomers with different cations.

In the early 1990s a solid one-piece urethane golf ball having a hole for the insertion of a chemi-luminescent tube was sold as a "Night Golf" ball. It was relatively translucent to create the glow, but it was far from having the performance characteristics of standard golf balls.

Two-piece balls have been sold under the tradename "Glow Owl" which utilize a white core and a cover with glow in the dark materials. This ball is believed to embody the technology described in U.S. Pat. No. 5,989,135 to Welch, which describes a "partially translucent" cover.

At the January 2001 PGA Show, Wilson displayed samples of "iWound" golf balls with clear covers. They were not balls for actual play but mock-ups used to display their new "lattice wound" technology. The lattice (discontinuous inner cover layer) was Hytrel and the Surlyn outer cover layer was clear. Both the Hytrel lattice and red core were visible through the clear cover. No markings were on the core or lattice.

To date, it has been difficult to properly attain the desired long-term appearance of polyurethane or polyurea compositions used in golf ball covers without adversely affecting golf ball performance. Many golf balls have at least one layer of "paint" covering the cover material, however paint has been shown to chip or otherwise become damaged during routine play. Hence, there is a need in the art for golf balls having a unique appearance and optimal performance characteristics.

SUMMARY OF THE INVENTION

The present invention is directed to a golf ball having at least a core and a cover. An intermediate layer may be disposed between the cover and the core. The cover preferably comprises a translucent or transparent thermoplastic or thermoset material. Preferably, the cover is made from polyurethane, polyurea, or ionomer resins. The resultant clear or transparent cover preferably has an average transmittance of visible light of at least about 40 percent, preferably about 60 percent, and more preferably more than 80 percent. The cover may additionally comprise an amount of dye to create a translucent colored cover through which the core or intermediate layer may be seen. Preferred dyes include fluorescent dyes from the thioxanthene, xanthene, perylene, perylene imide, coumarin, thioindigoid, naphthalimide and methine dye classes. The cover may also comprise an amount of reflective or pearlescent particulates such as metal flake, polyester foil, iridescent glitter or metalized film. Covers referred to as "translucent" preferably have an average transmittance of visible light of at least about 10 percent, preferably at least about 30 percent. As used herein, "translucent" includes "transparent."

The core of the present invention may comprise an amount of dye, but preferably comprises at least three dyes of different colors. The core may comprise a material having a swirled color pattern achieved through the stacking and extrusion of differently colored rubber sheets and the subsequent molding of lengths of the extruded rubber, or through the mixing of differently colored material before curing or setting and the subsequent molding of the uncured or unset material.

The core may alternatively comprise differently colored segments arranged in a variety of patterns. Each colored segment preferably comprises at least about five percent of the color coverage of the surface of the core.

In another embodiment of the present invention, the surface of the cover comprises a plurality of dimples and surface off-sets other than dimples. Said surface off-sets may include "artifacts" of the cover molding process, such as the witness lines created by the retraction of the pins supporting the core during injection molding or the parting line formed during compression molding. Other surface off-sets include depressed or raised text, logos, great circles, lines and stripes. Surface off-sets in the transparent or translucent cover create shadows on the surface of the core and have a pleasing aesthetic effect.

The surface of the core or intermediate layer of the golf ball may comprise projections such as raised edges, ridges, or raised points. The surface of the core or intermediate layer may also comprise depressions and valleys. The projections and depressions provide more surface area for the adhesion of the cover and hence improve playability, as the cover is less likely to delaminate or separate from the core or intermediate layer.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
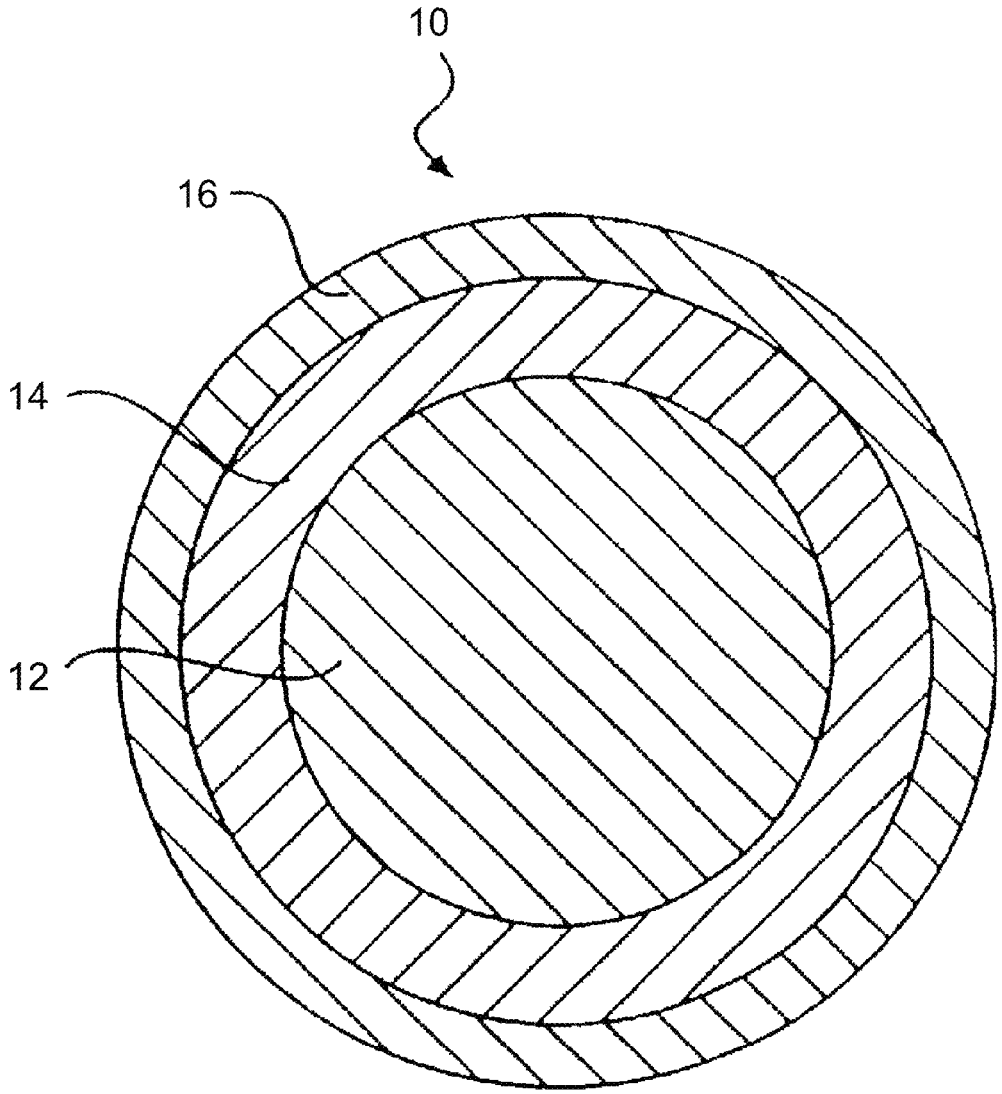
FIG. 1 shows a multi-layer golf ball of the present invention.

The present invention is directed to a golf ball comprising at least a core or a multi-piece core and a cover. The cover preferably comprises a translucent or transparent material that can be cast, injection molded, compression molded or reaction injection molded over a golf ball precursor or subassembly. Additionally, the cover comprises a plurality of dimples on its surface. The golf ball may also comprise an intermediate layer between the core and the cover. As taught in parent U.S. patent application Ser. No. 11/707,493 (published as US 2007/0149323), which has been incorporated by reference in entirety, the cover may comprise a substantially optically transparent or translucent material, so that the intermediate layer or core contributes to the color characteristics of the ball. The intermediate layer or core may be white, transparent or translucent, colored, or may have a multi-colored pattern. An example of a golf ball according to the present embodiment is shown in FIG. 1. Golf ball 10 comprises a center 12, an optional intermediate layer 14, and a transparent or translucent cover 16. Intermediate layer 14 may be opaque, transparent or translucent, or be white or comprise one or more colors. The cover may be translucent and may comprise an amount of pigment or dye, creating a colored but translucent cover under which the intermediate or outer core layer is visible. In this embodiment, the intermediate layer, which can be an outer core layer, may be colored or may comprise a pattern that is visible through the translucent outer cover. The intermediate or outer core layer may also be printed with indicia or other markings that may be viewed through the clear or translucent cover. The cover may also comprise an amount of reflective particulates to create a pearlescent or sparkle effect.

The colored core or intermediate layer of the above embodiment may be blue, green, yellow, pink, orange, lilac, purple, indigo, violet, or any Pantone Matching System color having an L* value less than about 80 on the CIELAB color measurement scale. Additionally, golf balls of the present invention having translucent covers wherein an amount of dye or pigment is added to the cover may be blue, green, yellow, pink, orange, lilac, purple, indigo, violet, or any Pantone Matching System color having an L* value less than about 80 on the CIELAB color measurement scale. The CIELAB color space has three dimensions or coordinates: L*, a*, and b*, where the L* component represents lightness, which is related to the cube root of the relative luminance of the object to the luminance of a "specified white object." The lightness value L* ranges from zero (0), which indicates black, to 100, which indicates white. The a* coordinate indicates the color's position between red/magenta and green. A negative a* value represents green and a positive a* value represents magenta. The b* coordinate indicates the position between the yellow (positive) and the blue (negative). The L* value and CIELAB color space, as well as CIELUV, CIELCH and other color spaces are known in the art.

Alternatively, the colored core or intermediate layer may be any Pantone Matching System color not including blue, green, yellow, pink or orange that has an L* value of about 80 or greater on the CIELAB color measurement scale. Where the golf ball of the present invention comprises a translucent cover comprising an amount of dye or pigment, the cover may be any Pantone Matching System color not including blue, green, yellow, pink or orange that has an L* value of about 80 or greater on the CIELAB color measurement scale.

The core may be a wound core, which is visible through the clear or translucent cover. The uneven surface of the wound core creates a unique visual effect, as the crevices and ledges created by the wound elastomeric material create shadows visible through the clear or translucent cover. An intermediate layer may be disposed around the wound core. In this instance, the intermediate layer is visible through the clear or translucent cover and may be white, colored, or comprise multiple colors in various patterns.

Figure 2:
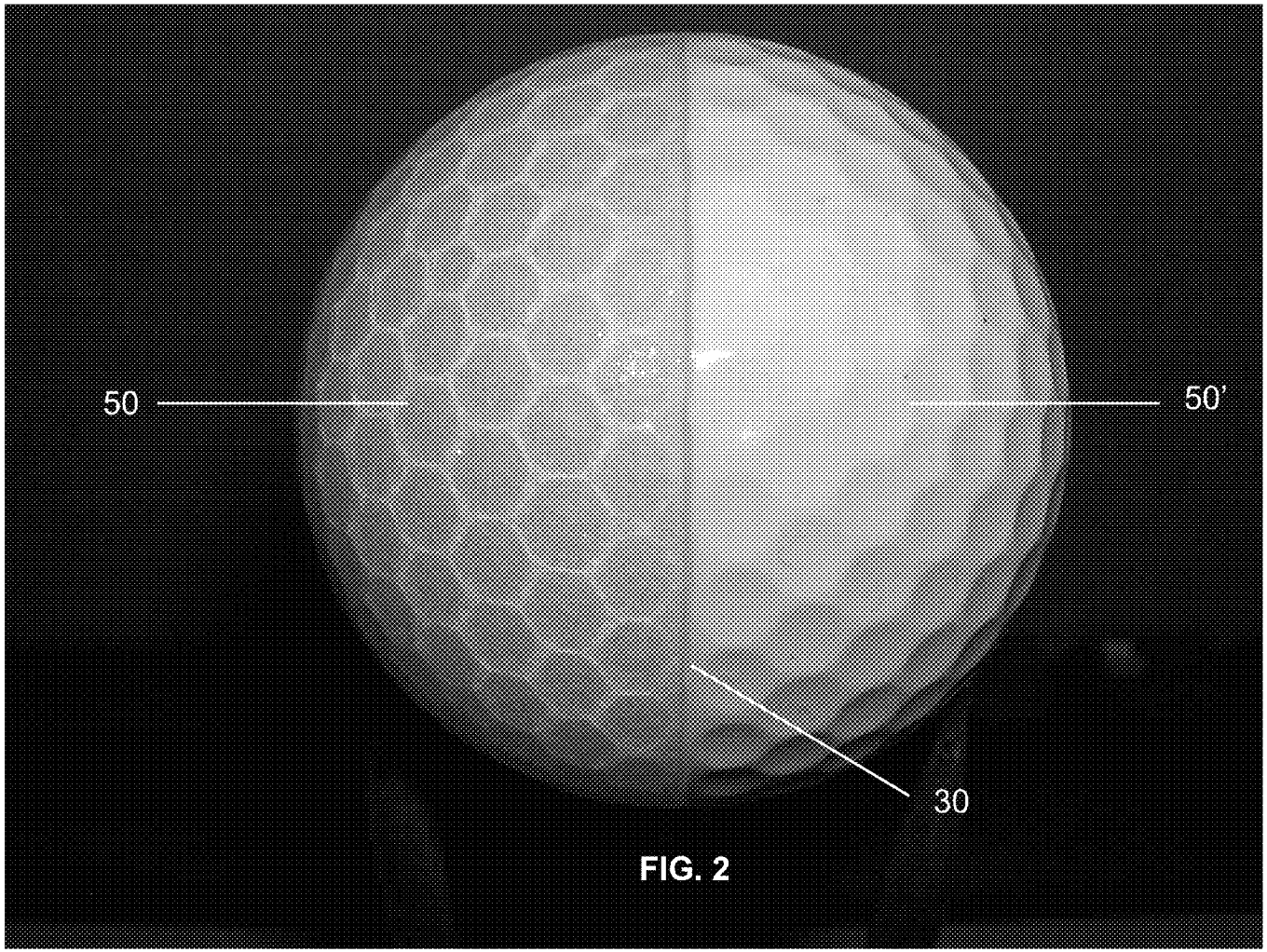
FIGS. 2 and 3 are color photographs of a golf ball with a translucent cover.
Figure 3:
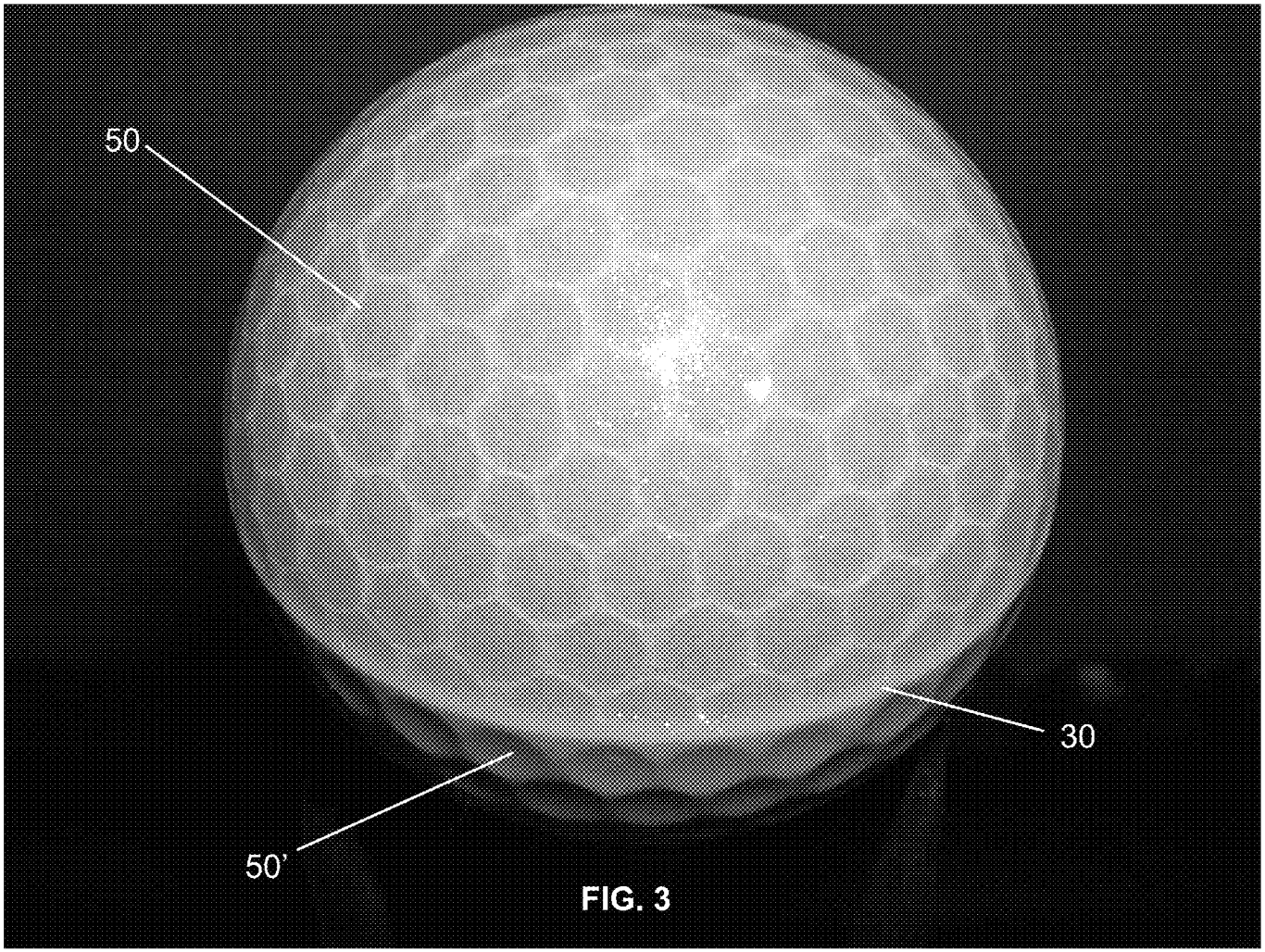
Figure 4:
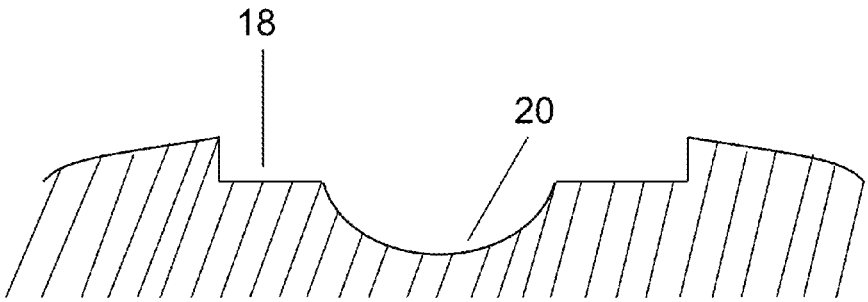
FIGS. 4 and 5 are cross-sectional views of dimples according to an aspect of the invention.
Figure 5:
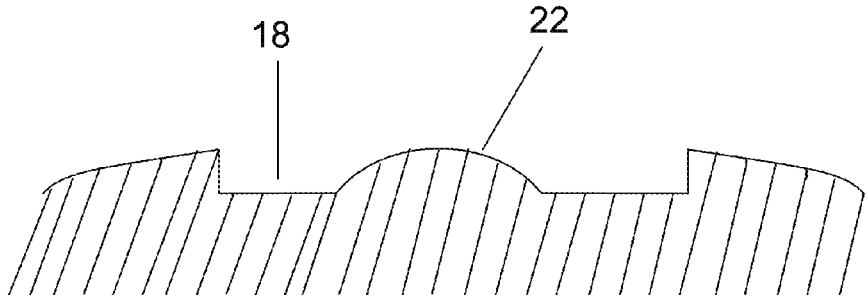

The clear or translucent cover of the golf ball of the present invention may comprise surface off-sets, or depressions or projections, on its surface. Surface off-sets include dimples and marking other than dimples. For instance, the surface of the translucent cover may comprise depressed logos, text, lines, arcs, circles or polygons. The surface may also comprise raised projections in the form of logos, text, lines, arcs, circles or polygons. The inclusion of such surface off-sets on the translucent cover creates a unique visual effect, as the juxtaposition of thick and thin portions of the translucent cover material creates a "shadow" effect on the opaque surface below the translucent cover. This "shadow" effect can be seen in the golf balls of FIGS. 2 and 3, which illustrate the honeycomb or beehive effect created by the outlines or shadows of the dimples on half 50. Half 50 also contains reflective flecks to highlight the visual effects of the inventive ball. Furthermore, line 30 shows the shadow of the parting line at the equation, which as best shown in FIG. 3, shows the thickness of the cover. The undimpled land surfaces and the depressions of the dimple pattern on the golf ball transmit light differently onto the surface of the layer immediately beneath the transparent cover. The dimples of the present invention may themselves include surface off-sets in the form of sub-depressions and projections. FIGS. 4 and 5 show a cross-section of a dimple 18 including a sub-depression 20 and a projection 22, respectively. Surface off-sets included on the translucent cover may also comprise artifacts from the molding process, such as a parting line or equator 30 circling the golf ball, discussed above.

The cover of the golf ball of the present invention may have a thickness between 0.02 and 0.1 inch. More preferably, the cover has a thickness between 0.02 and 0.08 inches. Most preferably, the cover has a thickness between 0.025 and 0.07 inches. Additionally, the golf ball preferably has a coefficient of restitution of at least 0.700 and an Atti compression between 50 and 120. The thickness of the intermediate layer may be between 0.01 and 0.06 inches. More preferably, the intermediate layer has a thickness between 0.02 and 0.055 inches. Most preferably, the intermediate layer has a thickness between 0.03 and 0.05 inches. The core of the golf ball of the present invention may have a diameter between 0.5 and 1.62 inches. More preferably, the core has a thickness between 0.8 and 1.61 inches. Most preferably, the core has a thickness between 1.0 and 1.6 inches.

Preferably, the transparent or translucent cover of the present invention is made from thermoplastic and thermoset materials, preferably polyurethane, polyurea, and ionomer resins.

Polyurethane that is useful in the present invention includes the reaction product of polyisocyanate, at least one polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), m-phenylene diisocyanate ("MPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; isocyanurate of HDI; triisocyanate of 2,4,4-trimethyl-1,6-hexane diisocyanate ("TMDI"), tetracene diisocyanate, napthalene diisocyanate, anthracene diisocyanate, and mixtures thereof. Polyisocyanates are known to those of ordinary skill in the art as having more than one isocyanate group, e.g., di-, tri-, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" isocyanate monomer, typically less than about 0.1 percent to about 0.5 percent free monomer. Examples of "low free monomer" diisocyanates include, but are not limited to Low Free Monomer MDI, Low Free Monomer TDI, Low Free MPDI, and Low Free Monomer PPDI.

The at least one polyisocyanate should have less than about 14 percent unreacted NCO groups. Preferably, the at least one polyisocyanate has less than about 7.9 percent NCO, more preferably, between about 2.5 percent and about 7.8 percent, and most preferably, between about 4 percent to about 6.5 percent. In an alternative embodiment, the at least one polyisocynanate could have more than about 14 percent unreacted NCO groups, which would be suitable if the golf balls are made by means of reaction injection molding (RIM).

As used herein, the term "percent NCO" or "% NCO" refers to the percent by weight of free, reactive, and unreacted isocyanate functional groups in an isocyanate-functional molecule or material. The total formula weight of all the NCO groups in the molecule or material, divided by its total molecular weight, and multiplied by 100, equals the percent NCO.

Any polyol available to one of ordinary skill in the art is suitable for use according to the invention. Exemplary polyols include, but are not limited to, polyether polyols, hydroxy-terminated polybutadiene and partially/fully hydrogenated derivatives, polyester polyols, polycaprolactone polyols, and polycarbonate polyols. In one preferred embodiment, the polyol includes polyether polyol, more preferably those polyols that have the generic structure:

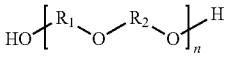

where $R_1$ and $R_2$ are straight or branched hydrocarbon chains, each containing from 1 to about 20 carbon atoms, and n ranges from 1 to about 45. Examples include, but are not limited to, polytetramethylene ether glycol, polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Preferred polyester polyols have the generic structure:

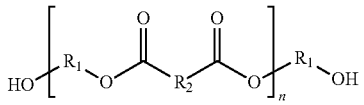

where $R_1$ and $R_2$ are straight or branched hydrocarbon chains, each containing from 1 to about 20 carbon atoms, and n ranges from 1 to about 25. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups. In another embodiment, polycaprolactone polyols are included in the materials of the invention.

Preferably, any polycaprolactone polyols have the generic structure:

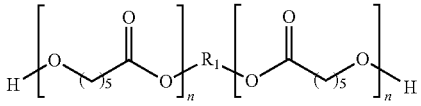

where $R_1$ is a straight chain or branched hydrocarbon chain containing from 1 to about 20 carbon atoms, and n is the chain length and ranges from 1 to about 20. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Preferably, any polycarbonate polyols have the generic structure:

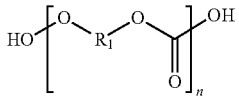

where $R_1$ is predominantly bisphenol A units -(p-$C_6H_4$)—$C(CH_3)_2$-(p-$C_6H_4$)— or derivatives thereof, and n is the chain length and ranges from 1 to about 20. Suitable polycarbonates include, but are not limited to, polyphthalate carbonate. The hydrocarbon chain can have saturated or unsaturated bonds, or substituted or unsubstituted aromatic and cyclic groups. In one embodiment, the molecular weight of the polyol is from about 200 to about 4000. Polyamine curatives are also suitable for use in the polyurethane composition of the invention and have been found to improve cut, shear, and impact resistance of the resultant balls. Preferred polyamine curatives have the general formula:

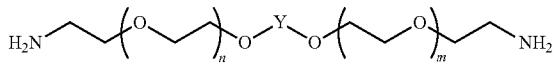

where n and m each separately have values of 0, 1, 2, or 3, and where Y is ortho-cyclohexyl, meta-cyclohexyl, para-cyclohexyl, ortho-phenylene, meta-phenylene, or para-phenylene, or a combination thereof. Preferred polyamine curatives include, but are not limited to, 3,5-dimethylthio-2,4-toluenediamine and isomers thereof (trade name ETHACURE 100 and/or ETHACURE 100 LC); 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; para, para'-methylene dianiline (MDA), m-phenylenediamine (MPDA), 4,4'-methylene-bis-(2-chloroaniline) (MOCA), 4,4'-methylene-bis-(2,6-diethylaniline), 4,4'-diamino-3,3'-diethyl-5,5'-dimethyl diphenylmethane, 2,2',3,3'-tetrachloro diamino diphenylmethane, 4,4'-methylene-bis-(3-chloro-2,6-diethylaniline), (LONZACURE M-CDEA), trimethylene glycol di-p-aminobenzoate (VERSALINK 740M), and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000. Preferably, n and m, each separately, have values of 1, 2, or 3, and preferably, 1 or 2.

At least one of a diol, triol, tetraol, hydroxy-terminated, may be added to the aforementioned polyurethane composition. Suitable hydroxy-terminated curatives have the following general chemical structure:

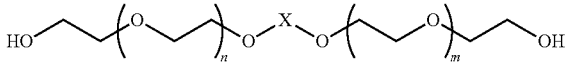

where n and m each separately have values of 0, 1, 2, or 3, and where X is ortho-phenylene, meta-phenylene, para-phenylene, ortho-cyclohexyl, meta-cyclohexyl, or para-cyclohexyl, or mixtures thereof. Preferably, n and m, each separately, have values of 1, 2, or 3, and more preferably, 1 or 2.

Preferred hydroxy-terminated curatives for use in the present invention include at least one of 1,3-bis(2-hydroxyethoxy)benzene and 1,3-bis-[2-(2-hydroxyethoxy)ethoxy] benzene, and 1,3-bis-{2-[2-(2-hydroxyethoxy)ethoxy] ethoxy}benzene; 1,4-butanediol; resorcinol-di-(β-hydroxyethyl)ether; and hydroquinone-di-(β-hydroxyethyl) ether; and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art. Both the hydroxy-terminated and amine curatives can include one or more saturated, unsaturated, aromatic, and cyclic groups. Additionally, the hydroxy-terminated and amine curatives can include one or more halogen groups. Suitable diol, triol, and tetraol groups include ethylene glycol, diethylene glycol, polyethylene glycol, propylene glycol, polypropylene glycol, lower molecular weight polytetramethylene ether glycol, and mixtures thereof. The polyurethane composition can be formed with a blend or mixture of curing agents. If desired, however, the polyurethane composition may be formed with a single curing agent.

The cover may alternatively comprise polyurea. In one embodiment, the polyurea prepolymer includes at least one diisocyanate and at least one polyether amine.

In this aspect of the invention the diisocyanate is preferably saturated, and can be selected from the group consisting of ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis (isocyanatomethyl)-cyclohexane diisocyanate; 4,4'-bis (isocyanatomethyl)dicyclohexane; 2,4'-bis (isocyanatomethyl)dicyclohexane; isophoronediisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; and mixtures thereof. The saturated diisocyanate is preferably selected from the group consisting of isophoronediisocyanate, 4,4'-dicyclohexylmethane diisocyanate, 1,6-hexamethylene diisocyanate, or a combination thereof. In another embodiment, the diisocyanate is an aromatic aliphatic isocyanate selected from the group consisting of meta-tetramethylxylene diisocyanate; para-tetramethylxylene diisocyanate; trimerized isocyanurate of polyisocyanate; dimerized uredione of polyisocyanate; modified polyisocyanate; and mixtures thereof.

The polyether amine may be selected from the group consisting of polytetramethylene ether diamines, polyoxypropylene diamines, poly(ethylene oxide capped oxypropylene) ether diamines, triethyleneglycoldiamines, propylene oxide-based triamines, trimethylolpropane-based triamines, glycerin-based triamines, and mixtures thereof. In one embodiment, the polyether amine has a molecular weight of about 1000 to about 3000.

The curing agent may be selected from the group consisting of hydroxy-terminated curing agents, amine-terminated curing agents, and mixtures thereof, and preferably has a molecular weight from about 250 to about 4000.

In one embodiment, the hydroxy-terminated curing agents are selected from the group consisting of ethylene glycol; diethylene glycol; polyethylene glycol; propylene glycol; 2-methyl-1,3-propanediol; 2-methyl-1,4-butanediol; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; tetra-(2-hydroxypropyl)-ethylene diamine; diethylene glycol di-(aminopropyl) ether; 1,5-pentanediol; 1,6-hexanediol; 1,3-bis-(2-hydroxyethoxy)cyclohexane; 1,4-cyclohexyldimethylol; 1,3-bis-[2-(2-hydroxyethoxy)ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

The amine-terminated curing agents may be selected from the group consisting of ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; and mixtures thereof.

In one embodiment, the composition further includes a catalyst that can be selected from the group consisting of a bismuth catalyst, zinc octoate, di-butyltin dilaurate, di-butyltin diacetate, tin (II) chloride, tin (IV) chloride, di-butyltin dimethoxide, dimethyl-bis[1-oxonedecyl)oxy]stannane, di-n-octyltin bis-isooctyl mercaptoacetate, triethylenediamine, triethylamine, tributylamine, oleic acid, acetic acid; delayed catalysts, and mixtures thereof. The catalyst may be present from about 0.005 percent to about 1 percent by weight of the composition.

Any method available to one of ordinary skill in the art may be used to combine the polyisocyanate, polyol or polyamine, and curing agent of the present invention. One commonly employed method, known in the art as a one-shot method, involves concurrent mixing of the polyisocyanate, polyol or polyether amine, and curing agent. This method results in a mixture that is inhomogenous (more random) and affords the manufacturer less control over the molecular structure of the resultant composition. A preferred method of mixing is known as the prepolymer method. In this method, the polyisocyanate and the polyol or polyether amine are mixed separately prior to addition of the curing agent. This method seems to afford a more homogeneous mixture resulting in a more consistent polymer composition.

As mentioned above, the cover layer may also comprise ionomeric materials, such as ionic copolymers of ethylene and an unsaturated monocarboxylic acid, which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid totally or partially neutralized, i.e., from about 1 to about 100 percent, with salts of zinc, sodium, lithium, magnesium, potassium, calcium, manganese, nickel or the like. In one embodiment, the carboxylic acid groups are neutralized from about 10 percent to about 100 percent. The carboxylic acid groups may also include methacrylic, crotonic, maleic, fumaric or itaconic acid. The salts are the reaction product of an olefin having from 2 to 10 carbon atoms and an unsaturated monocarboxylic acid having 3 to 8 carbon atoms.

The cover layer may also include at least one ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. The ionomer may include so-called "low acid" and "high acid" ionomers, as well as blends thereof. In general, ionic copolymers including up to about 15 percent acid are considered "low acid" ionomers, while those including greater than about 15 percent acid are considered "high acid" ionomers.

"Low acid" ionomers may be combined with a softening comonomer such as vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, and butyl methacrylate, and are believed to impart high spin to golf balls.

Covers comprising "high acid" ionomers are believed to impart low spin and longer distance to golf balls. A cover of the present invention may comprise about 15 to about 35 weight percent acrylic or methacrylic acid, making the ionomer a high modulus ionomer. An additional comonomer such as an acrylate ester (i.e., iso- or n-butylacrylate, etc.) can also be included to produce a softer terpolymer. The additional comonomer may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

The core of the present invention may comprise a polymer such as ionomeric copolymers and terpolymers, thermoset materials, ionomer precursors, thermoplastics, thermoplastic elastomers, polybutadiene rubber, balata, grafted metallocene-catalyzed polymers, single-site polymers, high-crystalline acid polymers, cationic ionomers, and mixtures thereof. The core may be colored or may be transparent or translucent. As used herein, and as discussed in commonly-owned U.S. Patent Publication No. 2007/0149323, previously incorporated by reference, the term "core" refers to any portion of the golf ball surrounded by the cover. In the case of a golf ball comprising three layers, the core is the portion including at least the inner-most center layer and the intermediate layer, also referred to as the outer core layer, immediately surrounding the center. In accordance with the present invention, the intermediate or outer core layer may comprise a solid polymeric material or may be a layer of wound elastomeric material. An intermediate or outer core layer comprising a solid polymeric material may be colored or may be transparent or translucent.

A golf ball having a core comprising two layers may be referred to as a "dual core" or a "multi-piece core." A golf ball of the present invention may also comprise a multi-piece core having more than two layers. The center of a dual core or multi-piece core may comprise a solid material or a fluid, i.e., a gas or liquid. The center may alternatively comprise a semi-solid such as a paste or gel.

A "clear" or "transparent" cover preferably has an average transmittance of visible light (e.g., between about 380 nm and about 770 nm or alternately between about 400 nm and about 700 nm) of at least about 40 percent, preferably at least about 60 percent, more preferably at least about 80 percent. The average transmittance referred to herein is typically measured for incident light normal (i.e., at approximately 90°) to the plane of the object and can be measured using any known light transmission apparatus and method, e.g., a UV-Vis spectrophotometer.

A "translucent" cover preferably has an average transmittance of visible light (e.g., between about 380 nm and about 770 nm or alternately between about 400 nm and about 700 nm) of at least about 10 percent, preferably at least about 20 percent, more preferably at least about 30 percent.

In one embodiment, the transparent or translucent cover comprises a plurality of dimples on its surface as well as surface off-sets other than dimples. The surface off-sets may be artifacts from the casting or molding of the cover. For example, during injection molding, a golf ball core or precursor is placed within a molding cavity comprising two hemispheres. The core or precursor is supported by pins so that it maintains its position in the center of the golf ball. Molten cover material is then injected into the molding cavity through apertures or gates and surrounds the core or precursor to harden and form the cover. As the molten cover material envelops the core or precursor, the supporting pins retract, allowing the molten material to fill in the cavities created by the pins. The retraction of the pins often causes the formation of "witness lines" on the cover about the area where the pins meet the mold. Likewise, during compression molding of a cover, a parting line may form along the equator of the golf ball. In accordance with the present invention, the witness lines created on the cover by the injection molding process or the parting line resulting from compression molding may be maintained on the clear or translucent cover to create unique visual effects, such as the enhancement of shadows on the core of the ball. As also mentioned above, this "shadow" effect can be seen in the golf balls of FIGS. 2 and 3, which illustrate the formation of the honeycomb and equator line 30 along the parting line of the balls.

In other embodiments, these artifacts from the manufacturing process may be removed by post-mold finishing processes such as vibration tumbling.

Figure 6:
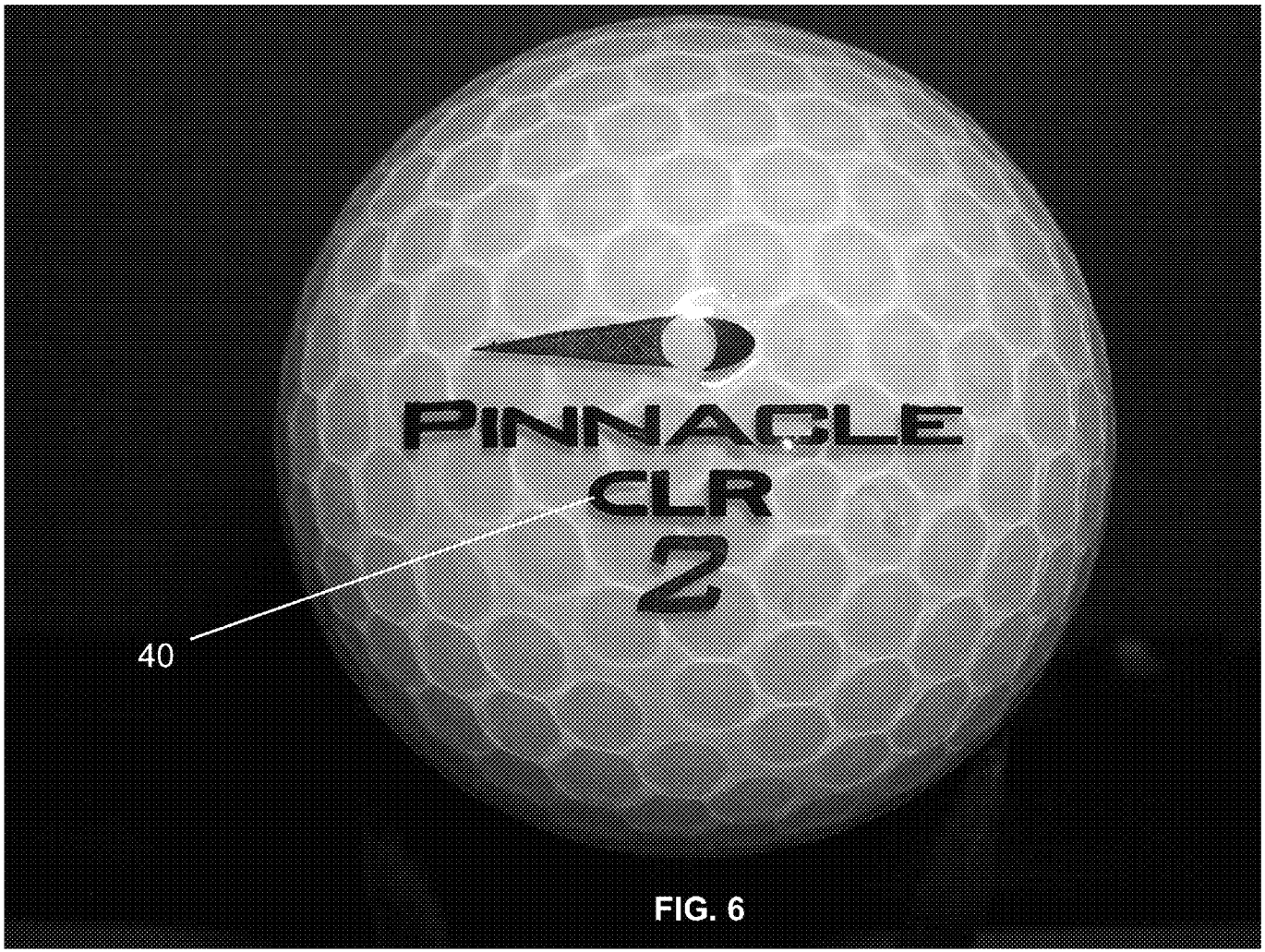
FIG. 6 is a color photograph of a golf ball with indicia.

Other non-limiting examples of surface off-sets include a molded stripe, which can be co-molded to provide the stripe with a color different than the core or the intermediate layer, so that the ball may identified as a practice ball; a molded line to aid in putting alignment; logos or indicia; raised text or indicia; great circles; lines or line segments; polygons or other shapes; arcs or curves; or text. By way of example, and not limitation, FIG. 6 is a photograph depicting such a golf ball with indicia 40. The indicia 40 appears to be floating above the honeycomb structures created from the shadows casted by the dimple pattern. The molded elements described above may be depressed into the cover or may rise as projections away from the surface of the cover.

The surface of the golf ball may also include optically active sites detectable by a ball-launching mechanism to allow for launch monitor testing. The sites may be reflective in the visible or invisible range.

Figure 7:
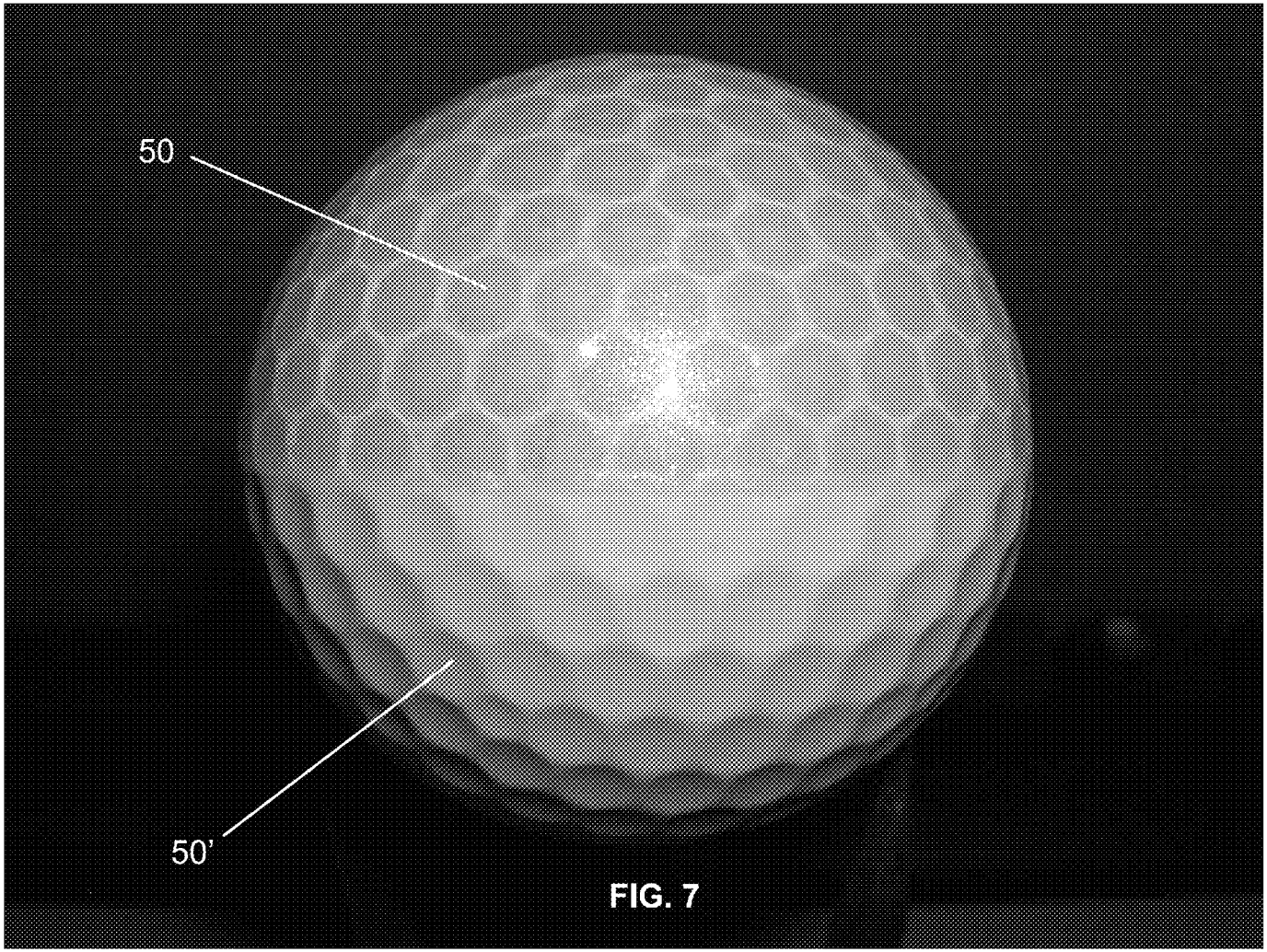
FIG. 7 is a color photograph of a golf ball with a cover having a translucent hemisphere and an opaque hemisphere.
Figure 8:
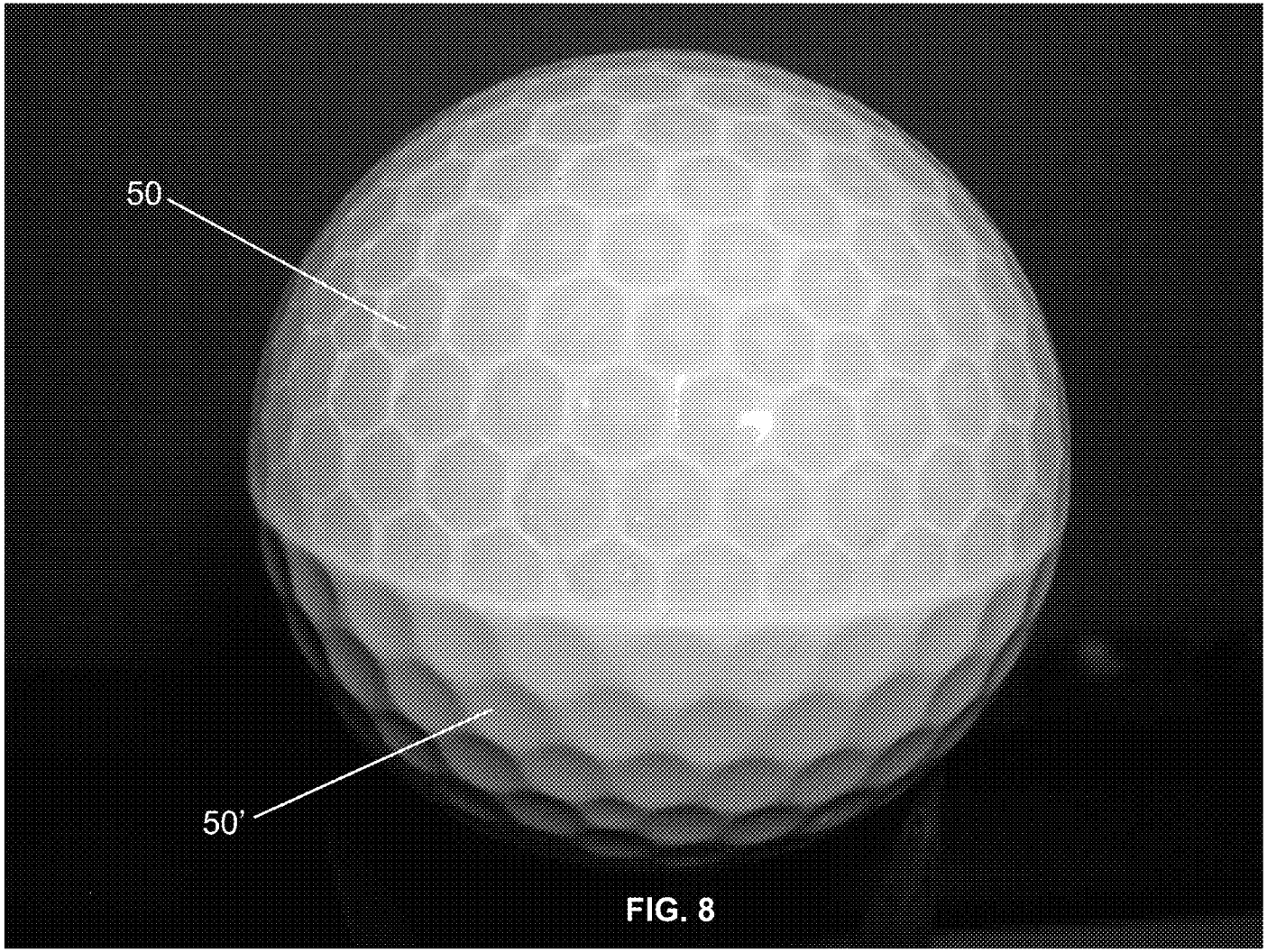
FIG. 8 is a color photograph of a golf ball with a cover having a colored translucent hemisphere and an opaque hemisphere.

In another embodiment of the current invention, the cover may be cast or compression molded. This process involves the joining of two cover hemispheres at an equator. Thus, as depicted in FIGS. 2, 3, and 7, the cover may comprise one hemisphere 50 comprising a transparent or translucent cover and one conventional opaque or white hemisphere 50'. Additionally, other inventive aspects of the present invention, such as a cover comprising a transparent or translucent material and having an amount of pigment or dye or an amount of reflective particulates, may be incorporated into only one hemisphere 50 of the golf ball cover, as illustrated in FIG. 8.

Dye or pigment may be added to the cover material to create a golf ball having a translucent colored cover. In the case of a golf ball with depressions molded into the cover, the addition of dye to the clear cover material can help to enhance the shadow effect of the depressions incorporated on the surface of the cover. The dye may be a fluorescent dye. In general, fluorescent dyes useful in the present invention include dyes from the thioxanthene, xanthene, perylene, perylene imide, coumarin, thioindigoid, naphthalimide and methine dye classes. Useful dye classes have been more completely described in U.S. Pat. No. 5,674,622, which is incorporated herein by reference in its entirety. Representative yellow fluorescent dye examples include, but are not limited to: Lumogen F Orange™240 (BASF, Rensselaer, N.Y.); Lumogen F Yellow™083 (BASF, Rensselaer, N.Y.); Hostasol Yellow™3G (Hoechst-Celanese, Somerville, N.J.); Oraset Yellow™8GF (Ciba-Geigy, Hawthorne, N.Y.); Fluorol 088™ (BASF, Rensselaer, N.Y.); Thermoplast F Yellow™084 (BASF, Rensselaer, N.Y.); Golden Yellow™D-304 (DayGlo, Cleveland, Ohio); Mohawk Yellow™D-299 (DayGlo, Cleveland, Ohio); Potomac Yellow™D-838 (DayGlo, Cleveland, Ohio) and Polyfast Brilliant Red™SB (Keystone, Chicago, Ill.).

In one aspect of the present invention, dyes or pigments may be added to any layer of the golf ball including, but not limited to, the cover and the core. The dyes or pigments may be inorganic or organic.

Figure 9:
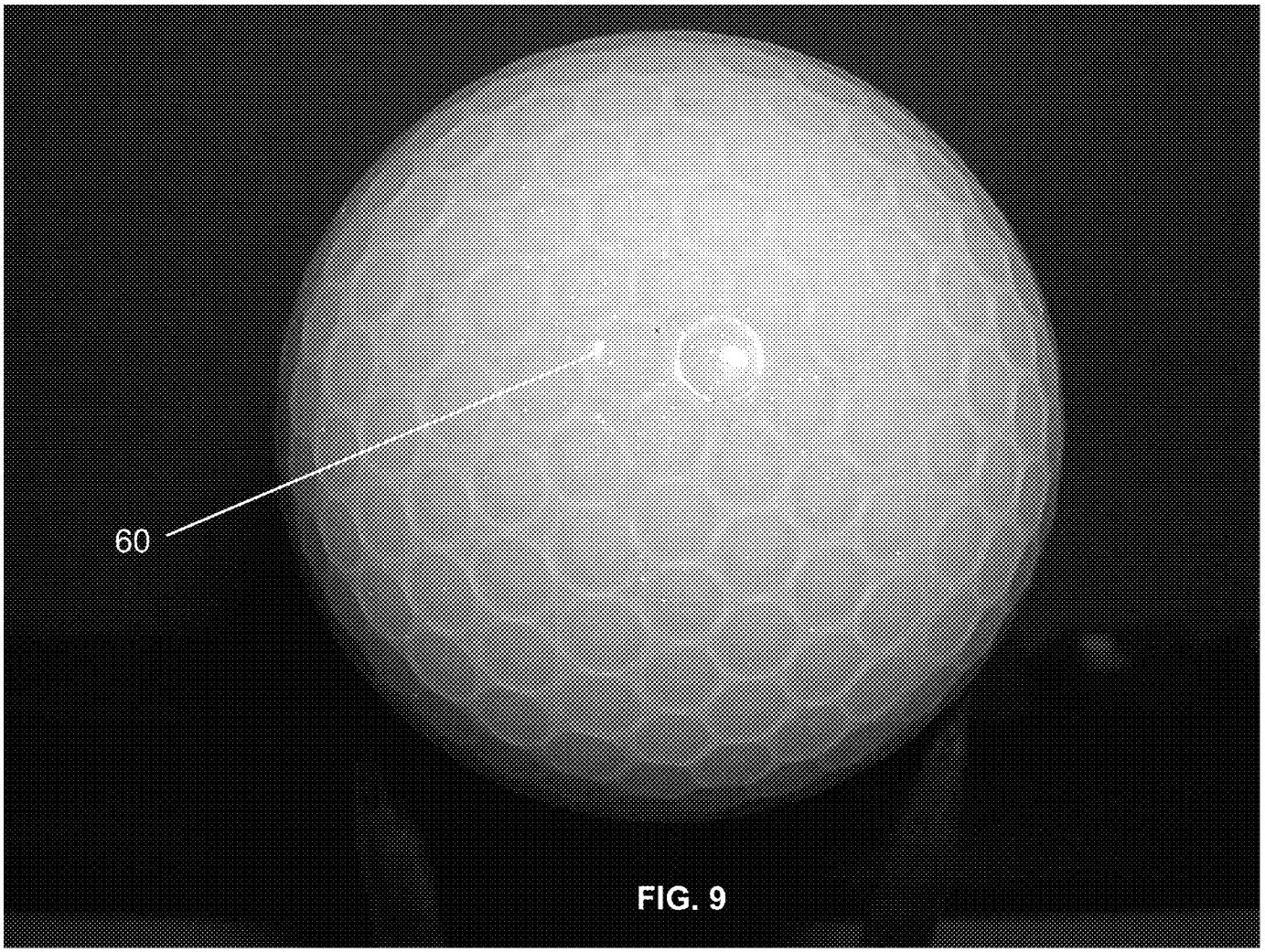
FIG. 9 is a color photograph of a golf ball with a cover having reflective particulates.

According to another embodiment, as illustrated in FIG. 9, the cover may comprise reflective particulates 60 to create the effect of sparkle, glitter, pearlescence or iridescence. The cover may contain reflective or optically active particulates such as described by Murphy in U.S. Pat. No. 5,427,378 which is incorporated herein by reference. Pearlescent pigments sold by the Mearle Corporation can also be used in this way. The reflective material 60 may comprise at least one member selected from the group consisting of metal flake, iridescent glitter, metalized film and colored polyester foil.

Figure 10:
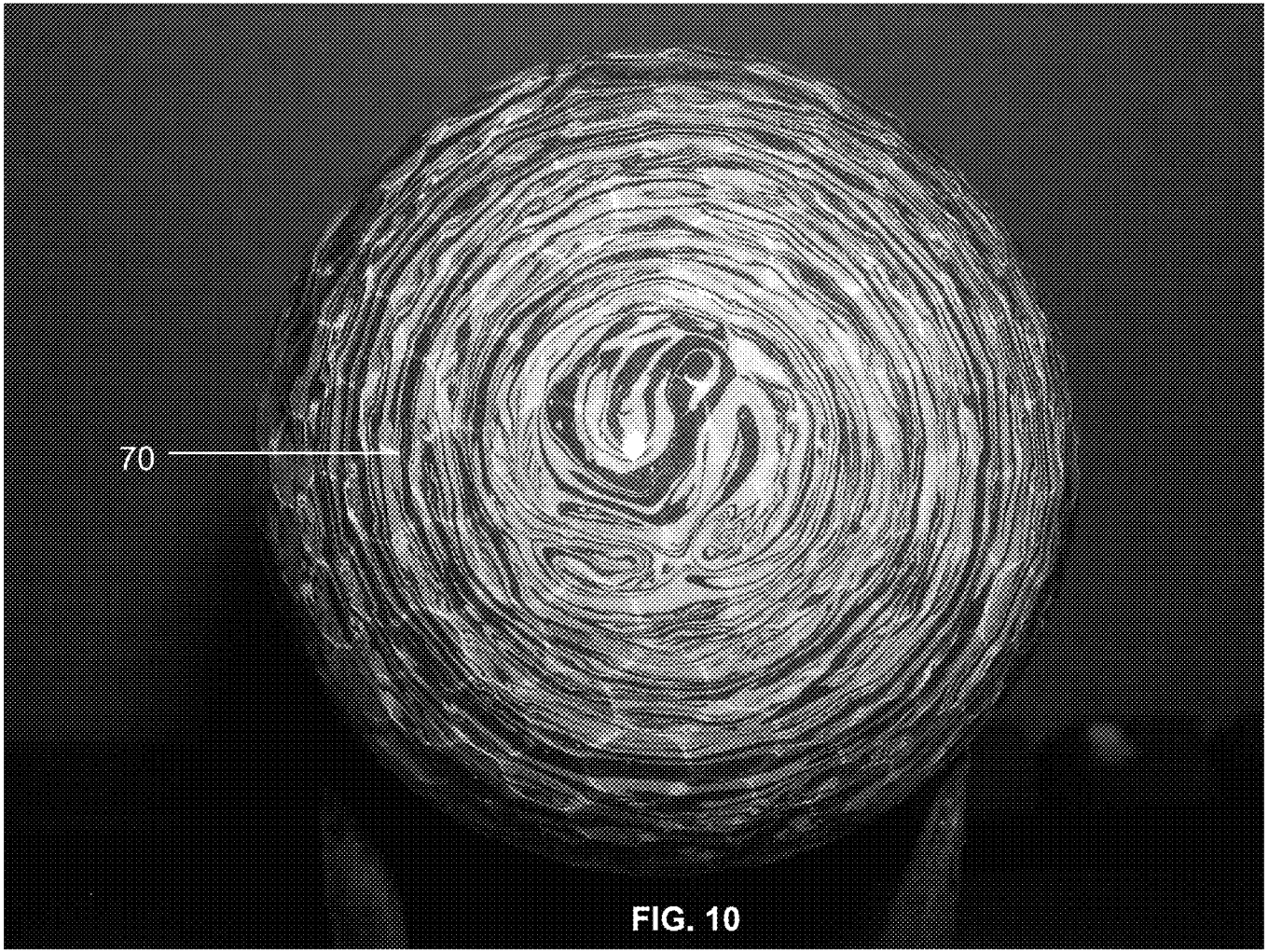
FIG. 10 is a color photograph of a golf ball having a core with a swirled color pattern.

In one embodiment of the present invention, as illustrated in FIG. 10, the core may comprise a swirled color pattern 70 achieved by mixing materials of different colors during the manufacture of the core. The swirled pattern 70 of the core can be created using the method described in U.S. Pat. No. 2,283,845, which is incorporated herein by reference in its entirety. The swirled core 70 may be comprised of materials such as a thermoset polybutadiene rubber or a thermoplastic Surlyn ionomer. In accordance with this aspect of the invention, the swirled core 70 may be constructed by stacking differently colored sheets of core material having individual thicknesses in accordance with the desired swirl pattern, moving the stacked sheets through a mill so as to adhere the sheets to one another, cutting the sheet mass into lengths, and extruding the lengths of stacked material through a tubing machine to create a cord of material now having a spiral pattern of differently colored material as seen in its cross-section. The cord may then be cut into appropriately sized cylindrical pieces or prep/perform to be molded into golf ball cores. The pieces are formed into a sphere through the use of a spherical mold. To achieve the desired swirled pattern 70, the cylindrical pieces may be given a number of slits or notches before molding.

A core having a swirled pattern 70 may also be achieved by mixing differently colored monomers or prepolymers before setting or curing to form the thermoset core or mixing differently colored thermoplastics to form the thermoplastic core.

In a variation of the above embodiment, the core may be a multi-piece core having a center and an outer core layer visible through the transparent or translucent cover. Preferably, the outer core layer has a swirled appearance. The outer swirled core layer may comprise molded rubber or thermoplastic halves having a swirled pattern. The center of the multi-piece core may comprise rubber or a blend thereof, rubber regrind, filler, foam, liquid, or other suitable materials.

Figure 11:
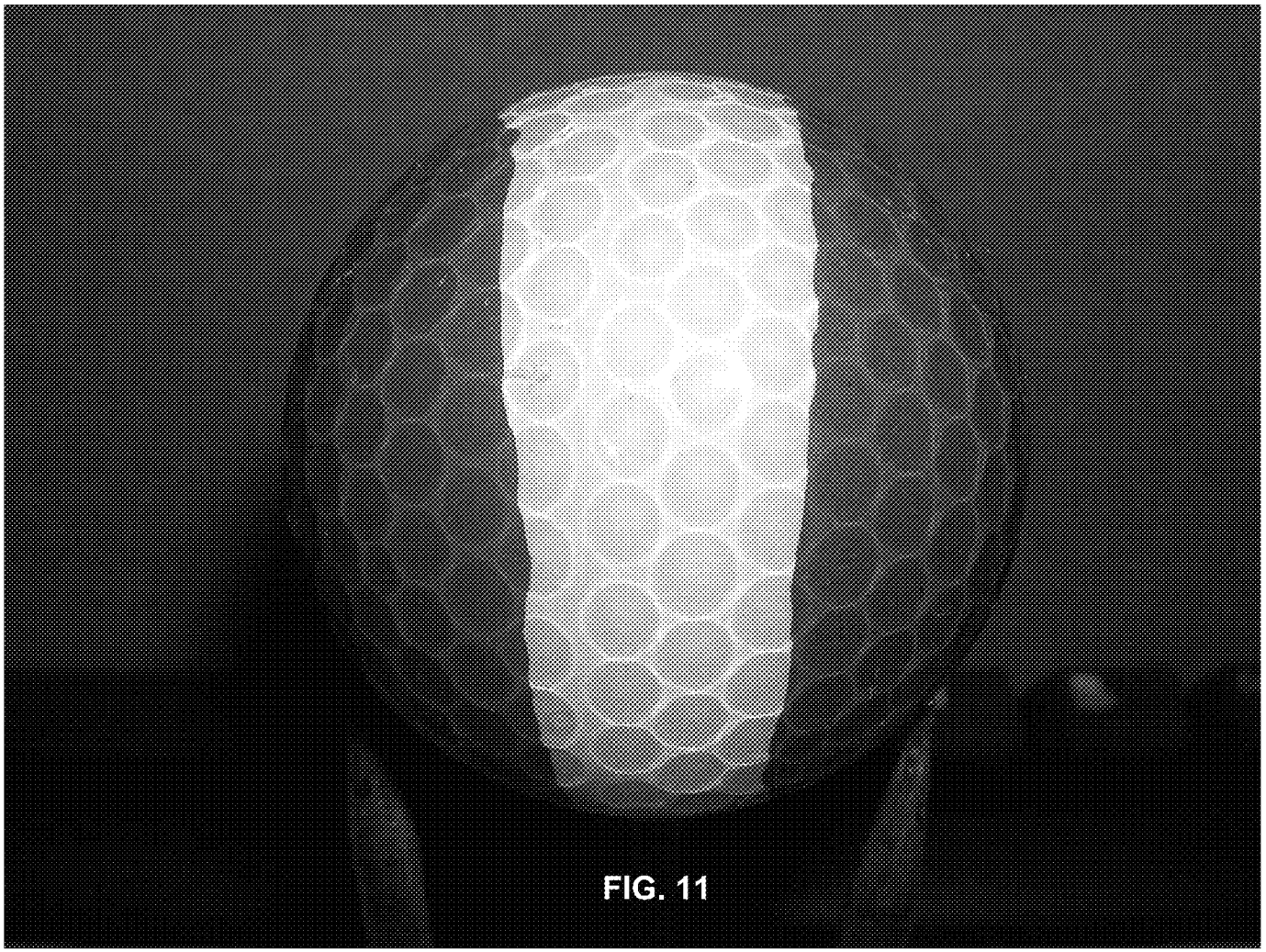
FIG. 11 is a color photograph of a golf ball having a core with three colored segments.
Figure 12:
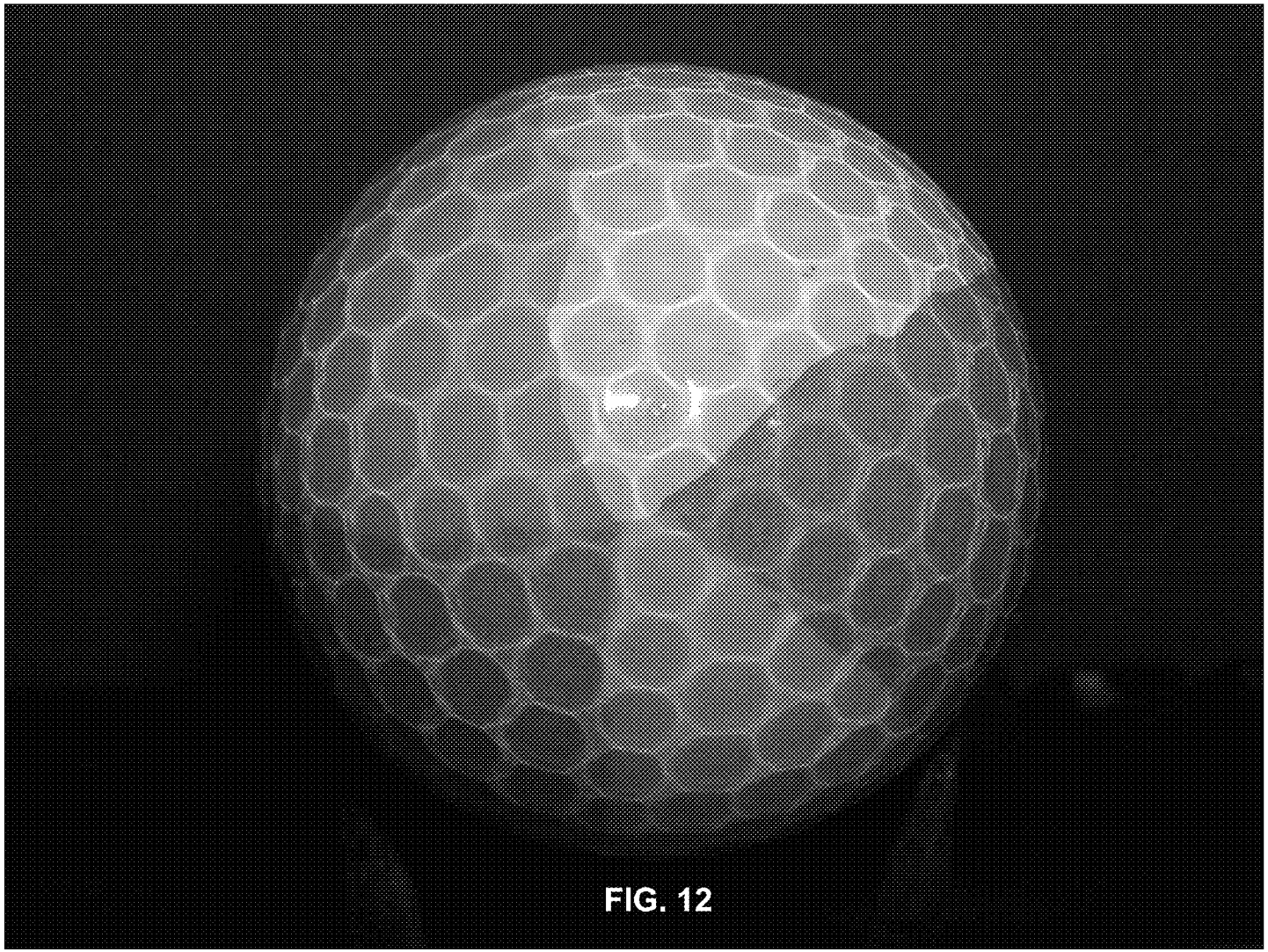
FIG. 12 is a color photograph of a golf ball having a core with five colored segments.

In another embodiment of the present invention, the core may be formed from a slug or prep or perform made from multiple segments of differently colored material. The slug may comprise at least three differently colored segments, and each color segment accounts for at least five percent of the total color coverage of the golf ball. The multi-colored slug is molded to form a multi-colored core. At least three segments are differently colored, however four segments may be differently colored, five segments may be differently colored, or all six segments may be differently colored. FIGS. 11-12 show non-limiting examples of a golf ball with cores according to this aspect of the invention. FIG. 11 depicts a golf ball having a core comprising three segments, each having a different color. FIG. 12 depicts a golf ball having a core comprising five colored segments. At least four segments are differently colored, however all five segments may be differently colored. In keeping with the present embodiment, the golf ball cores of FIGS. 11-12 comprise multiple colored segments, each colored segment comprising at least five percent of the total color coverage of the core.

The core may include a plurality of surface off-sets including ridges, raised edges, points or other projections on its outer surface. The clear or translucent cover is molded around the core by casting, injection molding, compression molding or other methods. The projections on the outer surface of the core provide more surface area for the adherence of the cover, decreasing the possibility of the separation or delamination of the cover from the core. The surface of the core may also include a plurality of depressions or valleys, also increasing surface area and so providing for better adhesion of the cover. The resulting ball is more durable than golf balls comprising smooth cores.

A golf ball of the present invention may alternatively comprise a clear or translucent cover, a core and an intermediate layer including a plurality of surface off-sets including ridges, raised edges, points or other projections on its outer surface. The clear or translucent cover is molded around the intermediate layer by casting, injection molding, compression molding or other methods. As in the above embodiment, the projections on the outer surface of the intermediate layer provide more surface area for the adherence of the cover, decreasing the possibility of the separation or delamination of the cover and core.

The transparent or translucent cover of the present invention may additionally act as a lens, magnifying the appearance of the core or intermediate layer below. Any text, logo or design printed on the core or intermediate layer will then also be magnified. More particularly, the transparent or translucent cover comprises a polymeric material having a magnification factor from about 2× to about 5× to make text or other markings printed on the surface of the layer immediately beneath the cover appear larger than its actual size. The actual size of any text or markings is typically small given the limited amount of space on the surface of the golf ball layer. Because a player may not be able to easily discern the fine text or marking, it is advantageous to magnify the physical appearance of the indicia. The magnified appearance of the core or intermediate layer or any marking on the surface of the core or intermediate layer may also enhance a player's ability to visualize the ball, and hence may improve a player's ability to strike the ball in the desired location.

The golf balls of the present invention may be painted, coated, or surface treated for further benefits. For example, trademarks or other indicia may be printed, i.e., pad-printed or ink jet printed, on the inner layer such that they are visible through the translucent cover. Protective and decorative coating materials, as well as methods of applying such materials to the surface of a golf ball cover, are well known in the golf ball art. Generally, such coating materials comprise urethanes, urethane hybrids, epoxies, polyesters and acrylics. If desired, more than one coating layer can be used. Further discussion of finishing treatments may be found in parent application Ser. No. 11/707,493, which was previously incorporated by reference in its entirety.

While it is apparent that the illustrative embodiments of the invention disclosed herein fulfill the objectives of the present invention, it is appreciated that numerous modifications and other embodiments may be devised by those skilled in the art. Additionally, features and/or elements from any embodiment may be used singly or in combination with other embodiments and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising a core and a cover and an optional intermediate layer disposed between the core and cover, wherein at least one of the core and the intermediate layer comprises any Pantone Matching System color including blue, green, yellow, pink, or orange having an L* value of about 80 or less; and wherein the cover comprises a translucent thermoset polyurethane material and an amount of pigment or dye such that the cover has any Pantone Matching System color including blue, green, yellow, pink, or orange that has an L* value of about 80 or less.

2. The golf ball of claim 1, wherein said thermoset polyurethane material is formed from an aliphatic isocyanate-based composition.

3. The golf ball of claim 1, wherein said pigment or dye is a fluorescent pigment or dye.

4. The golf ball of claim 1, wherein said pigment or dye is inorganic or organic.

5. The golf ball of claim 1, wherein the cover further comprises particulate material selected from the group consisting of metal flake, iridescent glitter, metalized film and colored polyester foil.

6. A golf ball comprising a core and a cover and an optional intermediate layer disposed between the core and cover, wherein at least one of the core and the intermediate layer comprises any Pantone Matching System color including blue, green, yellow, pink, or orange having an L* value of about 80 or less; and wherein the cover comprises a translucent aliphatic isocyanate-based polyurethane material and an amount of pigment or dye such that the cover has any Pantone Matching System color including blue, green, yellow, pink, or orange that has an L* value of about 80 or less.

7. The golf ball of claim 6, wherein said aliphatic isocyanate-based polyurethane material comprises a thermoset material.

8. The golf ball of claim 6, wherein said pigment or dye is a fluorescent pigment or dye.

9. The golf ball of claim 6, wherein said pigment or dye is inorganic or organic.

10. The golf ball of claim 6, wherein the cover further comprises particulate material selected from the group consisting of metal flake, iridescent glitter, metalized film and colored polyester foil.

11. A golf ball comprising a core and a cover and an optional intermediate layer disposed between the core and cover, wherein the cover comprises a substantially spherical outer surface, wherein said outer surface comprises a first set of surface off-sets, said first set comprising a plurality of dimples, wherein said cover comprises a translucent thermoset polyurethane material and an amount of pigment or dye such that the cover has any Pantone Matching System color including blue, green, yellow, pink, or orange that has an L* value of about 80 or less, wherein the golf ball further comprises a second set of surface off-sets comprising at least one surface off-set other than a dimple; and wherein at least one of the core and the intermediate layer comprises any Pantone Matching System color not including blue, green, yellow, pink, or orange that has an L* value of about 80 or less.

12. The golf ball of claim 11, wherein said thermoset polyurethane material is formed from an aliphatic isocyanate-based composition.

13. The golf ball of claim 11, wherein said second set of surface off-sets comprises depressions, wherein the depressions comprise logos, text, arcs, circles, lines, polygons, points or manufacturing artifacts.

14. The golf ball of claim 11, wherein said second set of surface off-sets comprises projections, wherein the projections comprise logos, text, arcs, circles, lines, polygons, points or manufacturing artifacts.

15. The golf ball of claim 11, wherein the second set of surface off-sets is located on the cover.

16. The golf ball of claim 11, wherein the second set of surface off-sets is located on the core.

17. The golf ball of claim 11, wherein said second set of surface off-sets comprises projections comprising ridges, raised edges or points.

18. The golf ball of claim 11, wherein the second set of surface off-sets is located on the optional intermediate layer.

19. The golf ball of claim 11, wherein the cover further comprises particulate material selected from the group consisting of metal flake, iridescent glitter, metalized film and colored polyester foil.

* * * * *